United States Patent [19]

Boyd

[11] 4,210,979

[45] Jul. 8, 1980

[54] HINGE

[75] Inventor: Kenneth J. Boyd, Jamestown, N.Y.

[73] Assignee: Weber-Knapp Company, Jamestown, N.Y.

[21] Appl. No.: 340

[22] Filed: Jan. 2, 1979

[51] Int. Cl.[2] ..... E05D 11/00

[52] U.S. Cl. ..... 16/147; 292/74

[58] Field of Search ..... 16/175, 147, 144, 139; 292/74, 16

[56] References Cited

U.S. PATENT DOCUMENTS

| | | | |
|---|---|---|---|
| 2,131,802 | 10/1938 | Harmon | 16/175 |
| 2,974,354 | 3/1961 | Matuzas | 16/175 |
| 3,203,031 | 8/1965 | Youngdale | 16/145 |
| 3,262,149 | 7/1966 | Gorton et al. | 16/147 |
| 3,418,683 | 12/1968 | Stone et al. | 16/145 |
| 3,623,185 | 11/1971 | Cartwright | 16/180 X |
| 3,688,342 | 9/1972 | Little | 16/144 |

*Primary Examiner*—Andrew V. Kundrat

*Attorney, Agent, or Firm*—Bean, Kauffman & Bean

[57] ABSTRACT

In a hinge latch mechanism for a cabinet door of the type including a strike and a keeper assembly mounted on a pair of door hinge parts and cooperating to releasably retain the door in closed position, the improvement featuring a novel keeper assembly and mode of mounting same on its associated hinge part.

8 Claims, 7 Drawing Figures

HINGE

BACKGROUND OF THE INVENTION

The present invention is generally directed to cabinet door hinge latch mechanisms of the type disclosed for instance in U.S. Pat. No. 3,418,683, wherein a spring biased keeper element is carried by a door mounted hinge part and a strike is formed integrally with a cabinet frame mounted hinge part; the keeper element cooperating with the strike to releasably retain the door in closed position relative to a cabinet. Patents illustrative of alternative constructions, wherein placement of the keeper and strike is reversed, include as by way of example, U.S. Pat. Nos. 3,203,031; 3,262,149; 3,623,185 and 3,688,342.

SUMMARY OF THE INVENTION

The present invention relates to an improved hinge latch mechanism featuring a novel keeper assembly and mode of mounting same on an associated hinge part. More particularly, the keeper assembly of the present invention is characterized by a keeper housing, which defines camming and restraining surfaces arranged for cooperation with a strike element and cooperates with its associated hinge part to fully conceal the spring operating and supporting mechanisms of the keeper assembly.

DRAWINGS

The nature and mode of operation of the present invention is now more fully described in the following detailed description taken with the accompanying drawings wherein.

DETAILED DESCRIPTION

Figure 1:
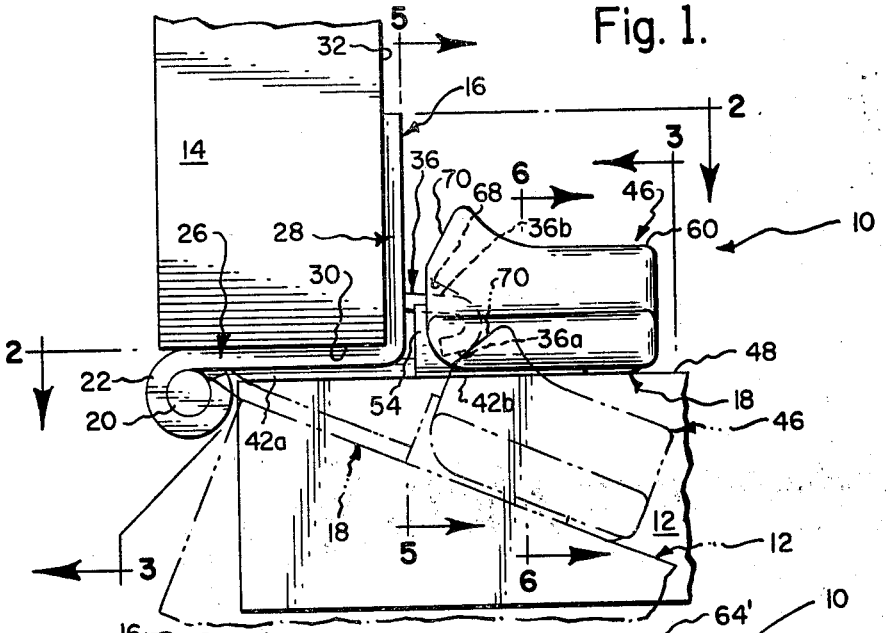
FIG. 1 is a fragmentary view of a door and cabinet shown in association with a hinge latch mechanism constructed in accordance with the present invention.
Figure 2:
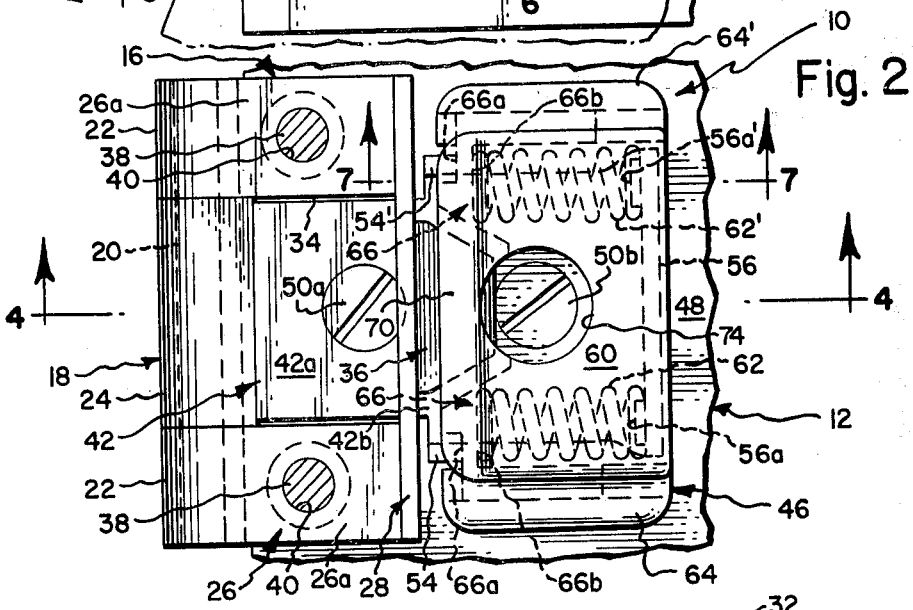
FIG. 2 is a sectional view taken generally along the line 2—2 in FIG. 1.
Figure 3:
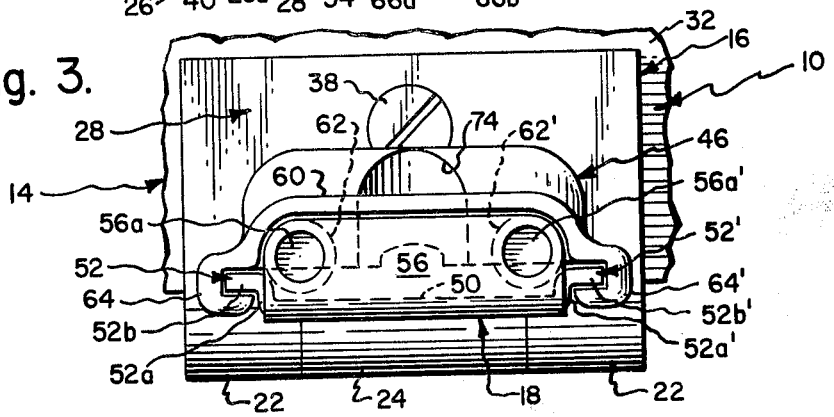
FIG. 3 is a view taken generally along the line 3—3 in FIG. 1.

Reference is now made more particularly to FIGS. 1 and 2, wherein the hinge latch mechanism formed in accordance with the present invention is generally designated as 10 and shown as being employed for pivotally mounting a door or closure 12 on a cabinet frame 14. Mechanism 10 includes a first or cabinet wing or hinge part 16 and a second or door wing or hinge part 18 pivotally joined by a suitable pivot arrangement, such as may be defined by a hinge pin or spindle 20 passing through curls or knuckles 22 and 24 formed integrally with wings 16 and 18, respectively.

Cabinet wing 16 is shown as including right angularly related flange portions 26 and 28, which in use are intended to abut against adjacently disposed cabinet frame front and inner surfaces 30 and 32, respectively. In the illustrated construction of mechanism 10, flange portion 26 is defined by a pair of parallel straps or legs 26*a*, which extend between curls 22 and flange portion 28 and are spaced apart to define an opening 34 of sufficient width to receive door wing 18 and allow movement thereof into the door closed position illustrated in FIG. 1. However, it will be understood that the design of flange portion 26 is a matter of choice and will depend upon the desired positioning or spacing of hinge pin 20 relative to front surface 30.

Figure 4:
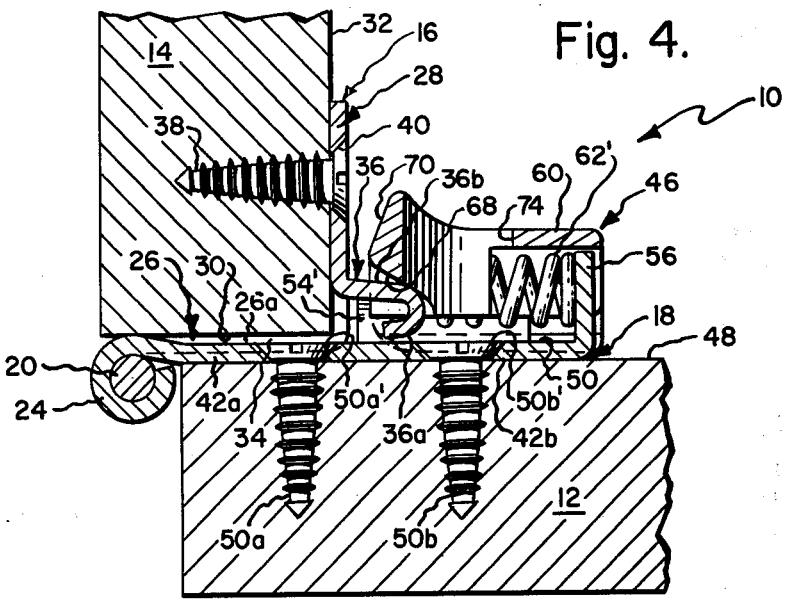
FIG. 4 is a sectional view taken generally along the line 4—4 in FIG. 2.

Flange portion 28 is best shown in FIGS. 1, 2 and 4 as mounting a strike element 36 having adjacently disposed camming and retainer surfaces 36*a* and 36*b*, respectively. Preferably, strike element 36 is formed integrally with flange portion 28, such as by a tab formed from part of the material removed during the step of forming clearance opening 34. Cabinet wing 16 may be secured to cabinet frame 14 in any desired manner, such as by screw fasteners 38 received within opening 40 provided in flange portions 26 and 28.

Door wing 18 is shown as being in the form of a single flange portion 42 having a generally T-shaped plan view configuration and comprising a hinge end portion 42*a* formed integrally with curl 24 and sized for receipt within clearance opening 34, and a transversely enlarged free end portion 42*b*, which serves to support a keeper assembly 46. Flange portion 42 may be fixed to the rear or inner surface 48 of door 12 by suitable means, such as screw fasteners 50*a* and 50*b* received within openings 50*a*′ and 50*b*′ formed in end portions 42*a* and 42*b*, respectively. As indicated above in the case of flange portion 26, the specific configuration of flange portion 42 and more particularly that of end portion 42*a* will depend upon the desired positioning of hinge pin 20.

Figure 5:
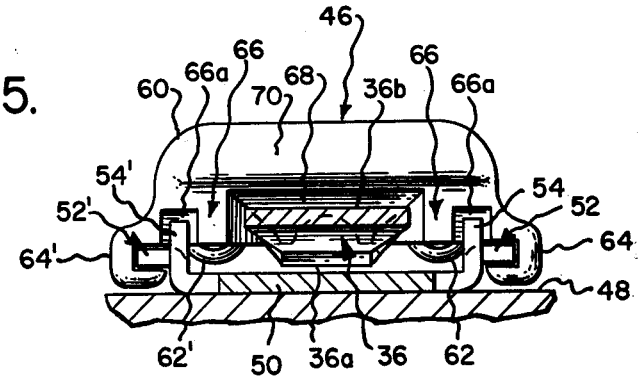
FIG. 5 is a sectional view taken generally along the line 5—5 in FIG. 1.
Figure 6:
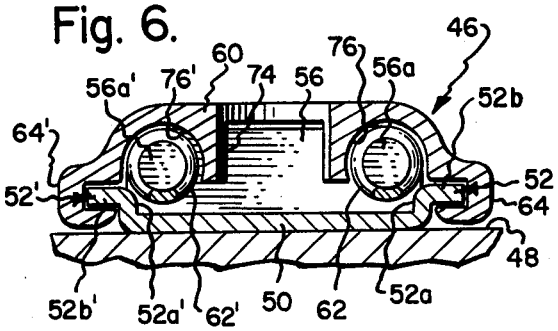
FIG. 6 is a sectional view taken generally along the line 6—6 in FIG. 1.

By referring primarily to FIGS. 3–6, it will be understood that in the preferred form of the present invention, free end portion 42*b* is characterized as having a planar central portion 50 bounded in part by parallel side marginal edge portions, which serve to define a pair of L-shaped guide members 52 and 52′ and a pair of first stop flanges 54 and 54′; and an end marginal edge portion in the form of an upstanding second stop flange 56, which is arranged to extend transversely between guide members 52 and 52′ and formed with a pair of locator projections 56*a* and 56*a*′. As best shown in FIGS. 4, 5, and 6, guide members 52 and 52′ are defined by upstanding base flanges 52*a* and 52*a*′, which are disposed in essential alignment with stop flanges 54 and 54′, and free edge or guide flanges 52*b* and 52*b*′, which are disposed to lie essentially parallel to central portion 50 and face outwardly in opposite directions. As will be apparent from viewing the drawings, door wing flange portion 42*b* and thus guide members 52 and 52′ are arranged to extend essentially normal to cabinet wing flange portion 28, when door 12 is disposed in its fully closed position.

Keeper assembly 46 is shown in the drawings as comprising a housing 60, which is preferably of integrally formed molded plastic construction, and spring operating means, such as may be defined by a pair of coil springs 62 and 62′. Housing 60 generally includes a pair of generally L-shaped, open ended channels 64 and 64′, which depend from adjacent opposite side edges of the housing and open in a facing relationship to slidably receive guide flanges 52*b* and 52*b*′; an abutment 66, which depends from and extends across the front end of the housing; and intersecting retaining and camming surfaces 68 and 70, respectively, which are also disposed adjacent the front end of the housing. As will be apparent from viewing FIGS. 4, 5 and 7, the cutting away of housing 60 to define retaining surface 68 serves to essentially divide abutment 66 into two like parts, wherein each part includes a forwardly facing recessed abutment surface 66*a* arranged in alignment with one of first stop flanges 54 and 54' and a rearwardly facing abutment surface 66*b* arranged in alignment with one of locator projections 56*a* and 56*a'*. Also, by reference to FIGS. 2, 4, 6 and 7, it will be seen that housing 60 is formed with a through access opening 74 and has its inner or lower surface formed with a pair of parallel locator recesses 76 and 76' arranged to extend rearwardly from abutment surfaces 66*b*.

Figure 7:
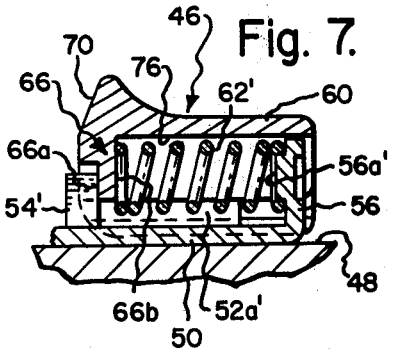
FIG. 7 is a sectional view taken generally along the line 7—7 in FIG. 2.

Springs 62 and 62' are best shown in FIGS. 2, 6 and 7 as extending lengthwise within locator recesses 76 and 76' with their relatively forwardly disposed ends arranged in engagement with abutment surface 66*b* and their relatively rearwardly disposed ends arranged in engagement with second stop flange 56 peripherally of locator projections 56*a* and 56*a'*. Recesses 76 and 76' primarily cooperate with projections 56*a* and 56*a'* to positionally locate the springs relative to housing 60 and free end portion 42*b*. Thus, a particularly important feature of the present invention is that the design of housing 60 and the mode of attaching same to flange portion 42 provides for an aesthetically and unobtrusive construction, wherein springs 62 and 62' and the mounting connection between the housing and flange portion are fully hidden from view when door 12 is in an open position. Moreover, the smoothly contoured outer surface of the enclosing housing and the remote cabinet mounting and rounded configuration of strike element 36 do not present any sharp edge or projection, which might cut a user and/or catch on the user's clothing, during insertion/removal of objects from the cabinet.

As will be apparent, springs 62 and 62' tend to bias housing 60 to the left as viewed in FIGS. 1, 2 and 4 in order to normally maintain abutment surfaces 66*a* in bearing engagement with first stop flanges 54 and 54' and thereby determine the latched position of keeper assembly 46. It will be noted that when keeper assembly 46 is disposed in its latched position, access opening 74 is arranged in axial alignment with mounting opening 50*b'* in order to permit insertion and/or removal of threaded fastener 50*b*.

It will be understood that housing 60 is operatively aligned with strike 36, such that upon closing movements of door 12, housing camming surface 70 will eventually be brought into operative engagement with strike camming surface 36*a*, as indicated in broken line in FIG. 1. As closing movement of the door continues, camming surfaces 70 and 36*a* cooperate to effect sliding movements of housing 60 away from its latching position against the bias of coil springs 62 and 62'. After the apex or juncture of surfaces 68 and 70 rides over the apex or juncture of surfaces 36*a* and 36*b*, so as to place retaining surface 68 in engagement with retaining surface 36*b*, springs 62 and 62' serve to return housing 60 to its original latched position and in doing so surfaces 68 and 36*b* cooperate to effect automatic or unassisted swinging movement of door 12 through at least several degrees into its fully closed and latched positions shown in full line in FIG. 1. When a user wishes to open door 12, it is necessary for the user to initially apply sufficient opening force to the door to effect movement of housing 60 from its latched condition against the bias of springs 62 and 62', as an incident to cooperative sliding engagement of surfaces 68 and 36*b*. Once the previously described apexes pass one another, during door opening movements, springs 62 and 62' are once again freed to return housing 60 to its latched position and door 12 is freed of the constraint afforded by strike 36 and may be swung to any desired open position.

I claim:

1. In a hinge latch mechanism for mounting a door on a cabinet or the like including first and second hinge parts joined by pivot means, said first hinge part being fixed to said cabinet and having a flange portion arranged to lie adjacent an inner surface of said cabinet adjacent a front surface thereof, said second hinge part being fixed to said door and including a flange portion arranged to lie adjacent a rear surface of said door adjacent a side edge thereof, said flange portion of said second hinge part being arranged essentially normal to said flange portion of said first hinge part when said door is in closed position, a strike and a keeper assembly mounted on said flange portions of said first and second hinge parts, respectively, and cooperating upon closing movements of said door for releasably latching said door in said closed position, the improvement wherein said keeper assembly comprises in combination:

a housing having camming and retaining surfaces;

mounting means for mounting said housing on said flange portion of said second hinge part for reciprocating movements between latched and release positions; and spring means for biasing said housing towards said latched position, said housing cooperating with said flange portion of said second hinge part for enclosing said spring means, and said camming and retaining surfaces being arranged to successively engage with said strike, during closing movements of said door, for initially forcing said housing to move from said latched position against said bias of said spring means and for subsequently retaining said door in its closed position, respectively.

2. The improvement according to claim 1, wherein said mounting means includes parallel guides defined by said flange portion of said second hinge part and recesses defined by said housing for slidably receiving said guides, said flange portion of said second hinge part being formed with first and second stop means disposed adjacent opposite ends of said guides, said housing being formed with abutment means disposed adjacent one end of said housing relatively adjacent said surfaces of said housing, said abutment means being arranged to engage said first of said stop means to define said latched position of said housing, and said spring means being arranged to engage with said abutment means and said second of said stop means for biasing said housing towards said latched position.

3. The improvement according to claim 2, wherein said guides and said first and second stop means are defined by upturned marginal edge portions of said flange portion of said second hinge part.

4. The improvement according to claim 3, wherein said housing is integrally formed of molded plastic material.

5. The improvement according to claim 3, wherein said second stop means extends transversely between said guides and is formed with a pair of locator projections, said housing is formed with a pair of locator recesses extending from said abutment towards an end of said housing opposite from said one end and arranged in a facing relationship to said flange portion of said second hinge part, and said spring means includes a pair of coil springs positionally located intermediate said locator recesses and said flange portion of said second hinge part, and said springs having first ends thereof arranged to engage said abutment means and second ends thereof receiving said locator projections of said second stop means.

6. In a hinge latch mechanism for mounting a door on a cabinet or the like including first and second hinge parts joined by pivot means, said first hinge part being fixed to said cabinet and having a flange portion arranged to lie adjacent an inner surface of said cabinet adjacent a front surface thereof, said second hinge part being fixed to said door and including a flange portion arranged to lie adjacent a rear surface of said door adjacent a side edge thereof, said flange portion of said second hinge part being arranged essentially normal to said flange portion of said first hinge part when said door is in closed position, a strike and a keeper assembly mounted on said flange portions of said first and second hinge parts, respectively, and cooperating upon closing movements of said door for releasably latching said door in said closed position, the improvement comprising in combination:

said flange portion of said second hinge part having a planar central portion bounded in part by parallel side marginal edge portions extending in a direction essentially normal to said pivot means and an end marginal edge portion disposed relatively remotely of said pivot means and extending transversely between said side edge portions, said side edge portions defining guide means and first stop means, said guide means being of generally L-shaped configuration having base flanges arranged to upstand from said planar portion and free edge flanges disposed essentially parallel to said planar portion and arranged to face in opposite directions, said first stop means being first stop flanges upstanding from said planar portion in essential alignment with said base flanges adjacent first ends of said guide means disposed relatively adjacent said pivot means and projecting relatively above said free edge flanges, said end edge portion defining a second stop means in the form of a second stop flange arranged to upstand from said planar portion;

said keeper includes a housing and spring means, said housing having a pair of generally U-shaped channels depending from adjacent opposite side edges thereof and opening in a facing relationship, said channels being arranged to slidably receive said free edge flanges for supporting said housing for reciprocating movements, an abutment depending from adjacent one end of said housing disposed relatively adjacent said pivot means, and intersecting camming and retaining surfaces extending transversely of said one end, said abutment means engaging with said first stop flanges to define a latched position of said housing, said spring means bearing on said abutment and said second stop flange for normally biasing said housing into said latched position, and said camming and retaining surfaces successively engaging with said strike during closing movements of said door, for initially forcing said housing to move from said latched position against said bias of said spring means and for subsequently retaining said door in its closed position.

7. The improvement according to claim 6, wherein said spring means includes a pair of coil springs, said second stop flange is formed with a pair of locating projections sized for receipt one within each of said coil springs, said housing is formed with a pair of spring locator openings arranged for cooperation with said pair of locating projections for positionally locating said springs intermediate said stop flange and said abutment, and said housing is integrally formed of molded plastic material.

8. The improvement according to claim 7, wherein said planar portion is formed with a through mounting opening for receipt of a door attachment device, and said housing is formed with a through access opening disposed in alignment with said mounting opening when said housing is in said latched position for affording access to said mounting opening.

* * * * *